US008932094B2

(12) United States Patent
Filen

(10) Patent No.: US 8,932,094 B2
(45) Date of Patent: Jan. 13, 2015

(54) MULTI-PART STRINGER FOR A SPORTS BOARD

(75) Inventor: Clinton Filen, Capetown (ZA)

(73) Assignee: Natural Corporation Pty Ltd, Osborne Park, Western Australia (AU)

( * ) Notice: Subject to any disclaimer, the term of this patent is extended or adjusted under 35 U.S.C. 154(b) by 131 days.

(21) Appl. No.: 13/575,748

(22) PCT Filed: Feb. 4, 2011

(86) PCT No.: PCT/AU2011/000110

§ 371 (c)(1),
(2), (4) Date: Jul. 27, 2012

(87) PCT Pub. No.: WO2011/094812

PCT Pub. Date: Aug. 11, 2011

(65) Prior Publication Data

US 2012/0322325 A1 Dec. 20, 2012

(30) Foreign Application Priority Data

Feb. 5, 2010 (AU) ..... 2010900462

(51) Int. Cl.
*B63B 35/79* (2006.01)

(52) U.S. Cl.
CPC ..... *B63B 35/7906* (2013.01)
USPC ..... 441/74

(58) Field of Classification Search
USPC ..... 441/65, 74, 79
See application file for complete search history.

(56) References Cited

U.S. PATENT DOCUMENTS

| | | | | |
|---|---|---|---|---|
| 4,767,369 | A | 8/1988 | Snyder | 441/68 |
| 4,798,549 | A | 1/1989 | Hirsch | 441/74 |
| 5,944,570 | A | 8/1999 | Appleby | 441/65 |
| 6,800,006 | B1 | 10/2004 | Itnyre et al. | 441/74 |
| 2008/0032575 | A1 * | 2/2008 | Wyrsta et al. | 441/74 |

OTHER PUBLICATIONS

International Search Report for International Application No. PCT/AU2011/000110, Apr. 19, 2011.

* cited by examiner

*Primary Examiner* — Edwin Swinehart
(74) *Attorney, Agent, or Firm* — Kusner & Jaffe

(57) ABSTRACT

A stringer for use in a board comprising an internal core and an outer skin, the stringer comprising a first compressible side member adjacent the outer skin on a first side of the board and a second compressible side member adjacent the outer skin on a second opposite side of the board. A central member is provided extending from a location adjacent the first member to a location adjacent the second side member, the first and second side members being relatively flexible in relation to the central member. Longitudinal flexing of the board results in compression of the first and second side members by the central member such that as the amount of flexing increases, the force transferred through the first and second side members from the outer skin to the central member increases, thereby increasing the stiffness of the board.

12 Claims, 1 Drawing Sheet

MULTI-PART STRINGER FOR A SPORTS BOARD

FIELD OF THE INVENTION

The present invention relates to a stringer to be used in boards such as kiteboards, surfboards, stand up paddle boards and windsurfing boards.

BACKGROUND TO THE INVENTION

Boards such as those used in surfing, kiteboarding, windsurfing and similar sports generally have a similar construction. A standard surfboard for example will generally comprise a foam blank formed from a material such as polyurethane coated in fibreglass and resin.

The blank is generally provided with a stringer consisting of a strip of suitable material (usually wood) down the central longitudinal axis. The stringer increases the strength of the board longitudinally to reduce the likelihood of breakage. However, the increased longitudinal stiffness of the board created by the stringer can reduce performance.

It is possible to provide board constructions that allow increased flex by changing the fibre orientation and varying the composite construction. However, such boards have a tendency to over flex, which can cause the laminate to fail due to failure of the fibre reinforcing, through tension, buckling of the laminate or delamination of the skin.

The present invention relates to a stringer design that is aimed at providing both increased flexibility in the board while reducing the likelihood of over flexing.

SUMMARY OF THE INVENTION

According to one aspect of the present invention there is provided a stringer for use in a board comprising an internal core and an outer skin, the stringer comprising:

a first compressible side member adjacent the outer skin on a first side of the board;

a second compressible side member adjacent the outer skin on a second opposite side of the board; and a central member extending from a location adjacent the first member to a location adjacent the second side member, the first and second side members being relatively flexible in relation to the central member;

wherein longitudinal flexing of the board results in compression of the first and second side members by the central member such that as the amount of flexing increases, the force transferred through the first and second side members from the outer skin to the central member increases, thereby increasing the stiffness of the board.

Preferably the thickness and compressibility of the first and second side members is such that beyond a predefined amount of flexing, the first and second side members are fully compressed and the central member is engaged with the outer skin.

Preferably the first and second side members are constructed of a high memory material.

In one embodiment, the first and second side members each comprise an elongate member having a generally rectangular cross section and the central member comprises an elongate member having a generally rectangular cross section, the width of the central member being relatively small in relation to the width of the first and second side members.

The central member preferably extends from a location adjacent a midpoint of the first side member to a location adjacent a midpoint of the second side member.

Preferably, the first and second side members comprise a compressible material having a thickness of at least 5 mm.

In one embodiment, the first and second side members comprise a compressible material having a thickness of around 10 mm.

In one embodiment, the first and second side members each include a covering layer on a side thereof adjacent the central member, wherein the covering layer comprises a layer of relatively rigid material that is engaged by the central member to spread the force of the engagement over the side member.

The covering layer may comprise a layer of fibreglass or carbon fibre.

In a preferred embodiment, the first and second side members comprise an expanded polypropylene.

The central member may be constructed of wood or of a composite material.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
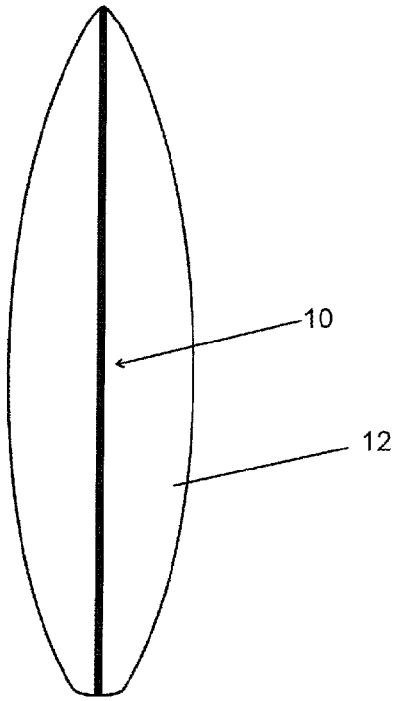
FIG. 1 is a front view of board construction utilising a central stringer.

Referring to the Figures, there is shown a stringer 10 for use in a board 12 to provide increased strength against longitudinal flexing of the board 12. The stringer 12 is provided along the length of the board 12 down a central longitudinal axis in a known fashion.

The board 12 comprises a core 14 surrounded by an outer skin 16. The core 14 is expected to be constructed of standard foam material, for example polyurethane foam. The outer skin 16 comprises a suitable composite laminate material.

The stringer 10 comprises a first side member 18, a second side member 19 and a central member 20. The first side member 18 comprises an elongate member located adjacent the outer skin 16 of the board 12 on a first side 22 thereof. The first side member 18 is located adjacent an inner surface of the outer skin 16 adjacent the first side 22 such that the first side member 18 is in engagement with the outer skin 16. Therefore, any longitudinal flexing of the board 12 will result in longitudinal flexing of the first side member 18.

The first side member 18 comprises in the embodiment shown an elongate member of material having a generally rectangular cross section. The first side member includes first and second side surfaces 24 and 25 parallel to the outer skin 16 and perpendicular first and second edge surfaces 26 and 27 joining ends of the first and second side surfaces 24 and 25. The first side surface 24 is adjacent the outer skin 16. The thickness of the first side member 18 (being the distance between the first and second side surfaces 24 and 25 in a direction perpendicular to the outer skin 16) is less than the width of the first side member 18 (being the distance between the first and second edge surfaces 26 and 27 in a direction parallel to the outer skin 16 but perpendicular to the longitudinal axis of the first side member 18)

The second side member 19 comprises also an elongate member located adjacent the outer skin 16 of the board 12 on a second side 23 thereof. The second side member 19 is located adjacent an inner surface of the outer skin 16 adjacent the second side 23 such that the second side member 19 is in engagement with the outer skin 16. Therefore, any longitudinal flexing of the board 12 will result in longitudinal flexing of the second side member 19.

The second side member 19 comprises in the embodiment shown an elongate member of material having a generally rectangular cross section. The second side member 19 includes first and second side surfaces 24 and 25 parallel to the outer skin 16 and perpendicular first and second edge surfaces 26 and 27 joining ends of the first and second side surfaces 24 and 25. The first side surface 24 is adjacent the outer skin 16. The thickness of the second side member 19 (being the distance between the first and second side surfaces 24 and 25 in a direction perpendicular to the outer skin 16) is less than the width of the first side member 18 (being the distance between the first and second edge surfaces 26 and 27 in a direction parallel to the outer skin 16 but perpendicular to the longitudinal axis of the second side member 19).

The central member 20 is provided to extend through the core 14 from a location adjacent the first side member 18 to a location adjacent the second side member 19.

Figure 2:
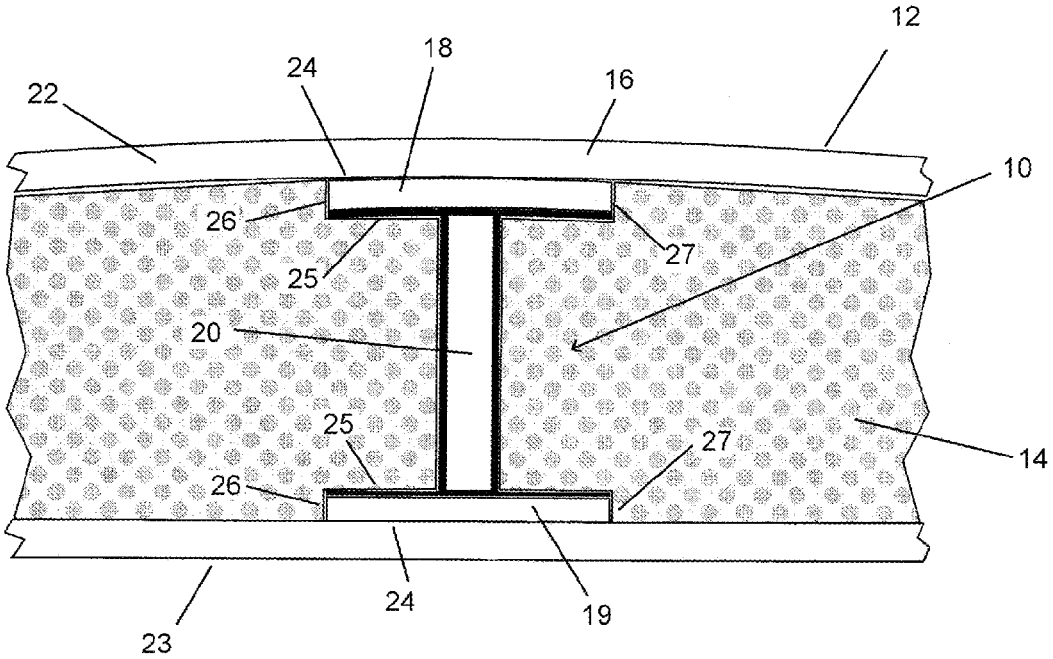
FIG. 2 is a cross sectional view of a stringer in accordance with the present invention.

The central member 20 extends from a location adjacent the midpoint of the first side member 18 to a location adjacent the midpoint of the second side member 19. The width of the central member 19 (the dimension parallel to the outer skin 16 but perpendicular to the longitudinal axis of the central member 20) is relatively small in relation to the thickness (the dimension perpendicular to the outer skin 16). The width of the central member 19 is also relatively small in relation to the width of the first and second side members 18 and 19. The first and second side members 18 and 19 and the central member 20 therefore form generally an I-shape (as can be seen in FIG. 2).

The first and second side members 18 and 19 in this embodiment are constructed of a compressible material and the central member 20 is constructed of a material relatively uncompressible in relation to the central member 20. The first and second side members 18 and 19 are also relatively flexible in relation to the central member 20. As the board 12 flexes, the first and second side members 18 and 19 therefore flex with the outer skin 16 of the board 12, providing minimal resistance to the flexing.

Due to the compressibility of the first and second side members 18 and 19, as the board 12 flexes, portions of the central member 20 engage with and compress the first and second side members 18 and 19. The more the first and second side members 18 and 19 are compressed, the greater the force transferred through the first and second side members 18 and 19 to the central member 20, and therefore the greater resistance to flexing provided to the board 12. If the first and second side members 18 and 19 are fully compressed, the central member 20 of the stringer 10 is fully engaged with the outer skin 16 and the maximum stiffness is provided.

The degree to which the board 12 may flex prior to full engagement with the central member 20 of the stringer can be varied by varying the thickness and the compressibility of the first and second side members 18 and 19.

The first and second side members 18 and 19 are constructed of a high memory material. That is, a material that can be compressed many times and still return to its original form.

In a preferred embodiment, the first and second side members are constructed of expanded polypropylene. The material may be, for example, 40 DV expanded polypropylene.

The thickness and compressibility of the first and second side members 18 and 19 is preferably such that the board 12 will flex around 20-30 mm prior to the central member 20 being fully engaged with the outer skin 16.

The thickness of the first and second side members 18 and 19 is at least 5 mm. In a preferred embodiment, the first and second side members 18 and 19 comprises expanded polypropylene having a thickness of around 10 mm.

In one embodiment, each of the first and second side members 18 and 19 includes a covering layer on the second side 25 thereof. The covering layer comprises a layer of relatively rigid material that is engaged by the central member 20. When the central member 20 engages with the first and second side members 18 and 19, the covering layer spreads the force of the engagement over the entire second side 25 of the side member so that the side member compresses more evenly. The covering layer may comprise a layer of fibreglass or carbon fibre.

While the central member 20 has been shown as a single, centrally located member, in a further embodiment more than one central member 20 may be provided and the central members 20 may not necessarily be located centrally in relation to the first and second side members 18 and 19.

Further, the central member 20 may be formed of layers of more than one material. The central member 20 may comprise a wood or composite material such as carbon fibre in a sandwiched arrangement with a high density foam core.

In use, a board incorporating the stringer 10 of the present invention will be provided with increased resistance to flexing as the amount of flex is increased. While the board flexes sufficiently for the central member 20 of the stringer 20 to only partially compress the first and second side members 18 and 19, the board will be relatively flexible, thereby improving the feel and performance of the board. As the board 12 flexes further, the central member can compress the first and second side members 18 and 19 to the point the load of further flexing is taken through the less flexible central member 20 in the manner of a conventional stringer. This reduces the likelihood of damage to the board due to over flexing. The stringer arrangement also allows for a lighter construction of board for a similar strength.

It will be readily apparent to persons skilled in the relevant arts that various modifications and improvements may be made to the foregoing embodiments, in addition to those already described, without departing from the basic inventive concepts of the present invention.

The invention claimed is:

1. A stringer for use in a board comprising an internal core and an outer skin, the stringer comprising:

a first compressible side member adjacent the outer skin on a first side of the board;

a second compressible side member adjacent the outer skin on a second opposite side of the board; and a central member extending longitudinally through the board dividing the internal core into portions located on lateral sides of the central member, the central member extending from a location adjacent the first side member to a location adjacent the second side member, the first and second side members being relatively flexible in relation to the central member;

wherein longitudinal flexing of the board results in compression of the first and second side members by the central member such that, as the amount of flexing increases, forces due to said flexing transferred through the first and second side members from the outer skin to the central member increase, thereby increasing the stiffness of the board relative to the stiffness of the board in an unflexed state.

2. A stringer in accordance with claim 1, wherein the thickness and compressibility of the first and second side members is such that beyond a predefined amount of flexing, the first and second side members are fully compressed and the central member is indirectly engaged with the outer skin, wherein flexing of the outer skin transfers force to the central member.

3. A stringer in accordance with claim 1, wherein the first and second side members are constructed of a high memory material.

4. A stringer in accordance with claim 1, wherein the first and second side members each comprise an elongate member having a generally rectangular cross section and the central member comprises an elongate member having a generally rectangular cross section, the width of the central member being relatively small in relation to the width of the first and second side members.

5. A stringer in accordance with claim 4, wherein the central member extends from a location adjacent a midpoint of the first side member to a location adjacent a midpoint of the second side member.

6. A stringer in accordance with claim 1, wherein the first and second side members comprise a compressible material having a thickness of at least 5 mm.

7. A stringer in accordance with claim 1, wherein the first and second side members comprise a compressible material having a thickness of around 10 mm.

8. A stringer in accordance with claim 1, wherein the first and second side members each include a covering layer on a side thereof adjacent the central member, wherein the covering layer comprises a layer of material being rigid relative to the first and second compressible side members, said layer engaged by the central member to spread the force of the engagement over the side member.

9. A stringer in accordance with claim 8, wherein the covering layer comprises a layer of fibreglass or carbon fibre.

10. A stringer in accordance with claim 1, wherein the first and second side members comprise an expanded polypropylene.

11. A stringer in accordance with claim 1, wherein the central member is constructed of wood.

12. A stringer in accordance with claim 1, wherein the central member is constructed of composite material.

* * * * *